US009810114B2

(12) United States Patent
Shewell

(10) Patent No.: US 9,810,114 B2
(45) Date of Patent: Nov. 7, 2017

(54) LUBRICATION PASSAGEWAY FOR LUBRICATION OF CAM FOLLOWER ASSEMBLY

(71) Applicant: Schaeffler Technologies AG & Co. KG, Herzogenaurach (DE)

(72) Inventor: Jeffrey Shewell, Rochester, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 41 days.

(21) Appl. No.: 14/879,409

(22) Filed: Oct. 9, 2015

(65) Prior Publication Data

US 2016/0153327 A1 Jun. 2, 2016

Related U.S. Application Data

(60) Provisional application No. 62/085,808, filed on Dec. 1, 2014.

(51) Int. Cl.
*F01L 1/14* (2006.01)
*F01M 11/02* (2006.01)
(Continued)

(52) U.S. Cl.
CPC ..... *F01M 9/10* (2013.01); *F01L 1/04* (2013.01); *F01L 1/14* (2013.01); *F01L 1/146* (2013.01);
(Continued)

(58) Field of Classification Search
CPC ..... F01L 2105/02; F01L 1/14; F01L 1/146; F01L 2105/00; F01L 2107/00;
(Continued)

(56) References Cited

U.S. PATENT DOCUMENTS 3,314,303 A * 4/1967 Maat ..... F01L 1/14 123/90.5
4,708,102 A * 11/1987 Schmid ..... F01L 1/14 123/90.35
(Continued)

FOREIGN PATENT DOCUMENTS

DE 3300032 A1 * 7/1984 ..... F01L 1/14

OTHER PUBLICATIONS

English language machine translation of DE 3300032.*

*Primary Examiner* — Mark Laurenzi
*Assistant Examiner* — Wesley Harris
(74) *Attorney, Agent, or Firm* — Volpe and Koenig, P.C.

(57) ABSTRACT

A cam follower assembly is provided including an improved lubricant flowpath. The assembly includes a generally cylindrical housing including an annular groove adapted to be in communication with a lubricant gallery in an engine block or cylinder head. An axial end of the housing includes skirt portions including openings, and one of the skirt portions includes a first recessed section indented from an outer lateral surface of the housing and extending axially between the annular groove and a respective one of the openings. A pin is mounted in the openings of the skirt portions and has a second recessed section indented from an outer lateral surface of the pin that extends to at least one of the ends of the pin. The second recessed section is in communication with the first recessed section, and a cam roller supported on the pin.

9 Claims, 3 Drawing Sheets

(51) Int. Cl.
*F01M 9/10* (2006.01)
*F02M 59/10* (2006.01)
*F01L 1/04* (2006.01)

(52) U.S. Cl.
CPC ..... *F01M 9/104* (2013.01); *F01M 9/105* (2013.01); *F01M 11/02* (2013.01); *F02M 59/102* (2013.01); *F01L 2105/00* (2013.01); *F01L 2105/02* (2013.01); *F01L 2107/00* (2013.01); *Y10T 74/2107* (2015.01)

(58) Field of Classification Search
CPC ..... F01M 11/02; F01M 9/105; F01M 9/104; F02M 59/102; Y10T 74/2107
USPC ..... 74/569, 519; 123/90.16, 90.35, 90.48
See application file for complete search history.

(56) References Cited

U.S. PATENT DOCUMENTS

| | | | | |
|---|---|---|---|---|
| 2008/0006233 | A1* | 1/2008 | Bartley ..... | F01L 1/146 123/90.48 |
| 2015/0136053 | A1 | 5/2015 | Haefner et al. | |

* cited by examiner

LUBRICATION PASSAGEWAY FOR LUBRICATION OF CAM FOLLOWER ASSEMBLY

INCORPORATION BY REFERENCE

The following documents are incorporated herein by reference as if fully set forth: U.S. Provisional Patent Application No. 62/085,808, filed Dec. 1, 2014.

FIELD OF INVENTION

The present invention relates to a cam follower, and is more particularly related to lubricating an interface between components of a cam follower.

BACKGROUND

Cam follower assemblies are used in engines to transmit forces between a cam on a camshaft and an associated valve stem. Known cam follower assemblies include a housing having skirt portions with openings, a pin fixed in the openings of the skirt portions, and a cam roller supported on the pin that contacts the cam on the camshaft. A very tight clearance exists between a radially inner surface of the cam roller and a radially outer surface of the pin. The interface between the cam roller and the pin requires lubrication to reduce friction and heat caused by the high rotational speeds of the cam roller. It would be desirable to provide an improved method of lubricating an interface between a pin and cam roller in a cam follower assembly.

SUMMARY

A cam follower assembly including an improved lubricant passageway for lubricating an interface between a pin and cam roller is provided. The cam follower assembly includes a generally cylindrical housing having an annular groove adapted to be in communication with a lubricant gallery in an engine block or cylinder head. An axial end of the housing includes first and second skirt portions each including an opening defined therethrough. At least one of the first and second skirt portions includes a first recessed section indented from an outer lateral surface of the housing and extending axially between the annular groove and a respective one of the openings of the first and second skirt portions. A pin is provided that includes first and second ends fixed in the openings of the first and second skirt portions. The pin has a second recessed section indented from an outer lateral surface of the pin that extends to at least one of the first or second ends of the pin. The second recessed section is in communication with the first recessed section. A cam roller is supported on the pin and contacts a cam on a camshaft.

A method of providing lubricant to an annular space defined between a cam roller and a pin in a cam follower assembly is also provided. The method includes providing a cam follower assembly including a generally cylindrical housing having an annular groove adapted to be in communication with the lubricant gallery in the engine block or cylinder head, and an axial end of the housing includes first and second skirt portions, each including an opening defined therethrough. At least one of the first and second skirt portions includes a first recessed section indented from an outer lateral surface of the housing and extending axially between the annular groove and a respective one of the openings of the first and second skirt portions. A pin is provided that includes first and second ends fixed in the openings of the first and second skirt portions, and the pin has a second recessed section indented from an outer lateral surface of the pin that extends to at least one of the first or second ends of the pin. The second recessed section is in communication with the first recessed section. A cam roller is supported on the pin and contacts a cam on a camshaft. The method includes supplying hydraulic fluid to the annular space defined between the cam roller and the pin via the lubricant gallery, the annular groove, the first recessed section, and the second recessed section.

Additional embodiments are described below and in the claims.

BRIEF DESCRIPTION OF THE DRAWINGS

The foregoing Summary and the following detailed description will be better understood when read in conjunction with the appended drawings, which illustrates a preferred embodiment of the invention. In the drawings.

DETAILED DESCRIPTION OF THE PREFERRED EMBODIMENTS

Figure 1:
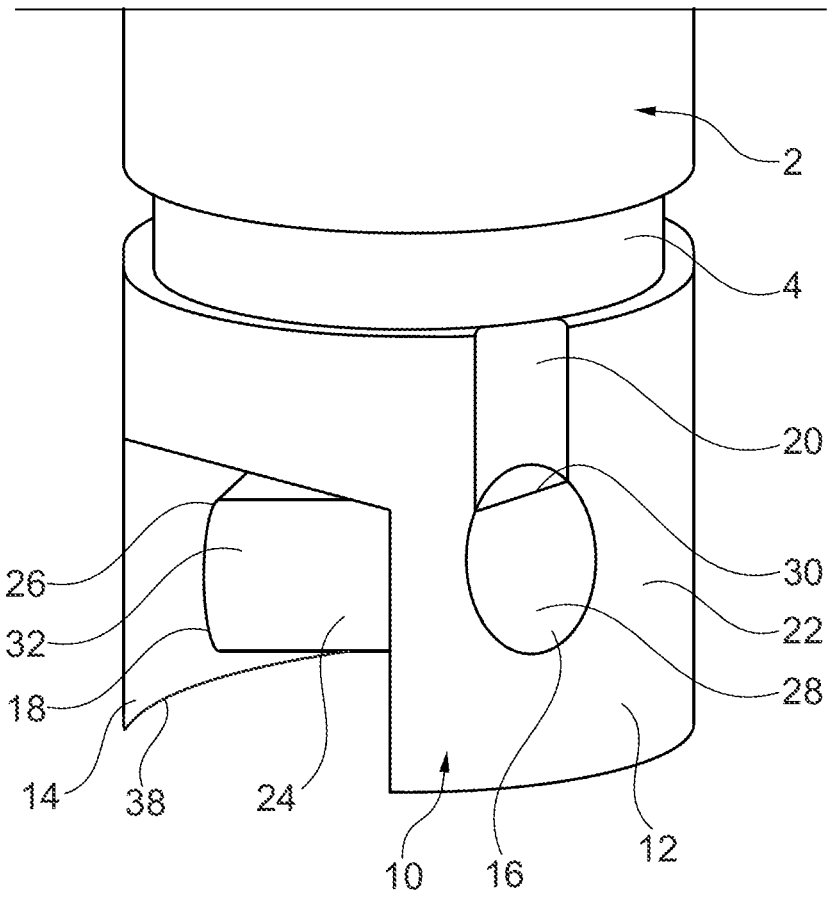
FIG. 1 shows a perspective partial view of a cam follower assembly according one embodiment of the invention.

Certain terminology is used in the following description for convenience only and is not limiting. The words "front," "rear," "upper," and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
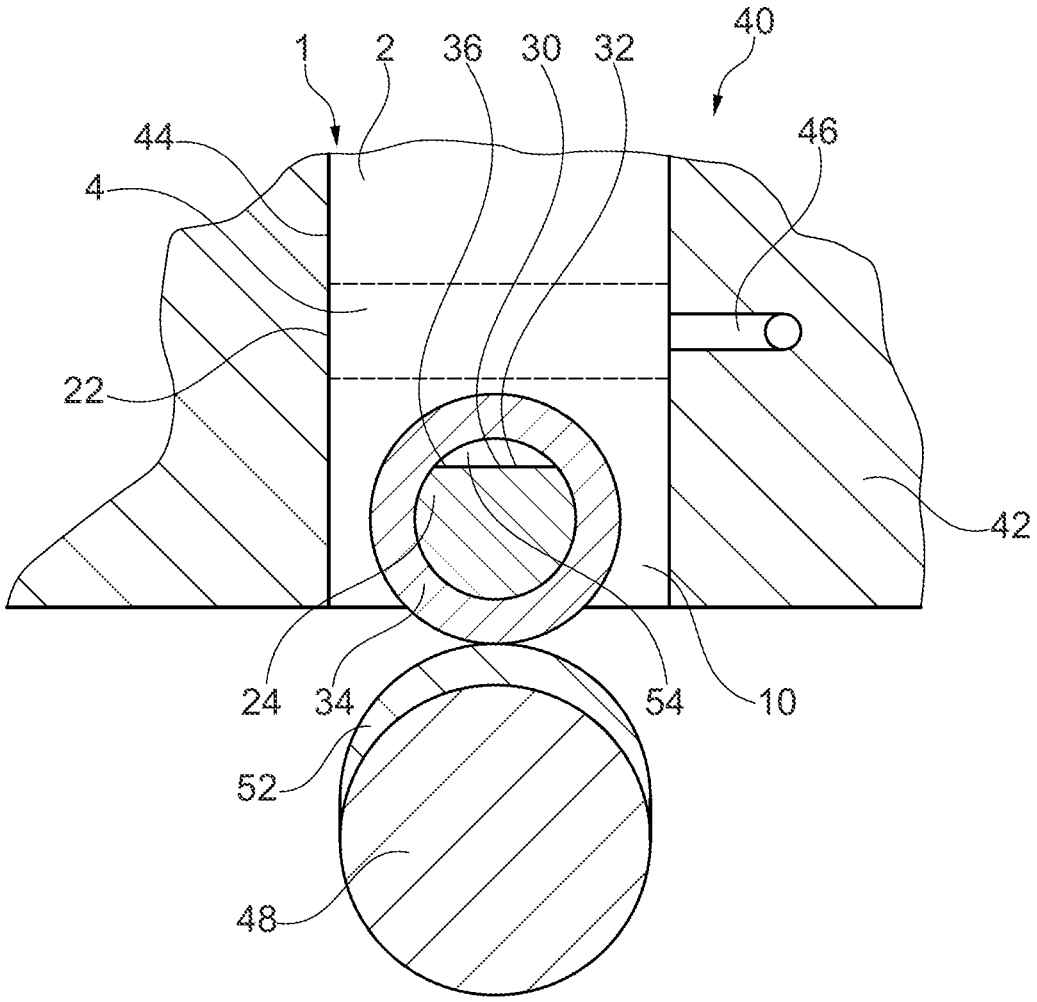
FIG. 2 shows a cross section view of a cam follower arrangement according to one embodiment of the invention.

As shown in FIGS. 1 and 2, a cam follower assembly 1 is provided. The cam follower assembly 1 includes a generally cylindrical housing 2 including an annular groove 4 adapted to be in communication with a lubricant gallery in an engine block or cylinder head. One of ordinary skill in the art will recognize that more than one lubricant gallery can be provided in the engine block or cylinder head. An axial end 10 of the housing 2 includes first and second skirt portions 12, 14, each including an opening 16, 18 defined therethrough. At least one of the first and second skirt portions 12, 14 includes a first recessed section 20 indented from an outer lateral surface 22 of the housing 2 and extending axially between the annular groove 4 and a respective one of the openings 16, 18 of the first and second skirt portions 12, 14. A pin 24 including first and second ends 26, 28 is fixed in the openings 16, 18 of the first and second skirt portions 12, 14. The pin 24 is preferably bronze. One of ordinary skill in the art will recognize that other materials could be used to form the pin 24. The pin 24 has a second recessed section 30 indented from an outer lateral surface 32 of the pin 24 that extends to at least one of the first or second ends 26, 28 of the pin 24, and preferably along the entire length of the pin 24. The second recessed section 30 is in communication with the first recessed section 20. A cam roller 34 is supported on the pin 24. The cam roller 34 can be formed by a bearing outer ring supported by needles or rolling elements on the pin 24, a rolling bearing having an inner ring supported on the pin 24 and an outer ring supported by rolling elements on the inner ring, or possibly by a plain bearing. The combination of the lubricant gallery, the annular groove 4, the first recessed section 20, and the second recessed section 30 define a lubricant passageway which provides increased lubrication to the interface between the cam roller 34 and the pin 24 compared to conventional cam follower assemblies.

Figure 3:
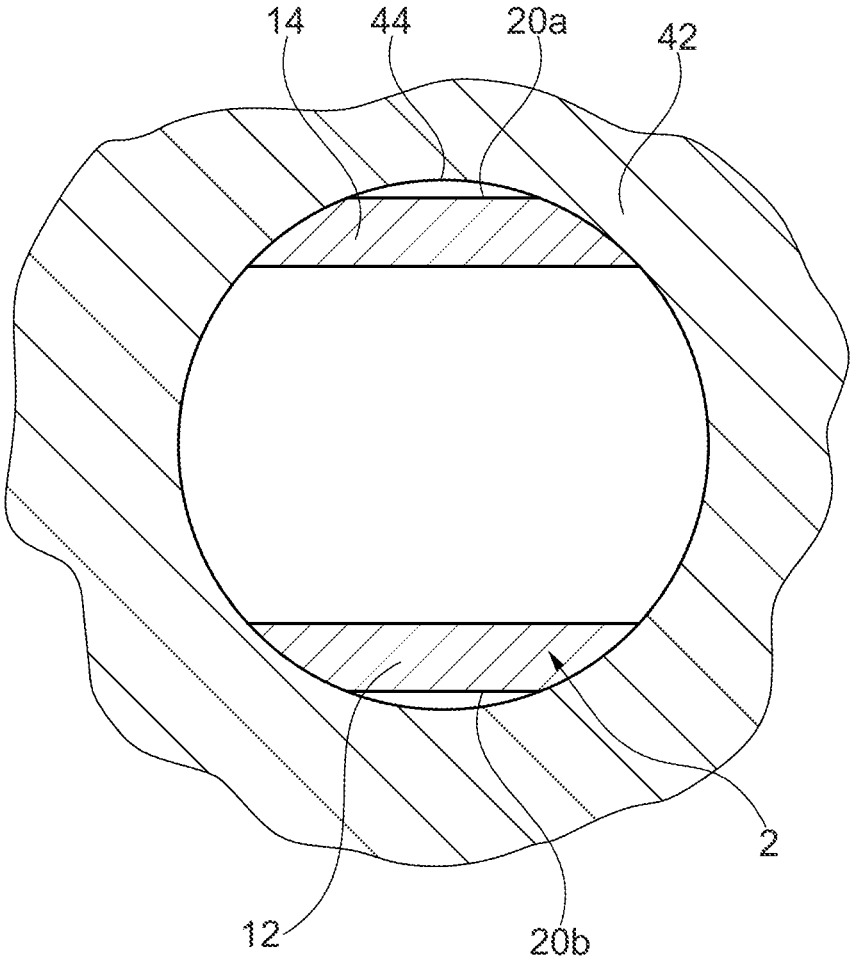
FIG. 3 shows a top cross section view of a cam follower assembly according to another embodiment of the invention.

In one embodiment, the first and second recessed sections 20, 30 are formed as flats on the housing 2 and/or the pin 24. In one embodiment, the first and second recessed sections 20, 30 are milled to remove material from an outer surface of the housing 2 and the pin 24, respectively. In another embodiment, the first and second recessed sections 20, 30 are formed or ground. One of ordinary skill in the art recognizes that the first and second recessed sections 20, 30 can be formed by other formation methods. The second recessed section 30 preferably extends axially between the first and second ends 26, 28 of the pin 24. The second recessed section 30 is preferably arranged on a side 36 of the pin 24 facing away from an axial end face 38 of the first and second skirt portions 12, 14. In one embodiment shown in FIG. 3, the housing 2 includes two of the first recessed sections 20*a*, 20*b*, each being indented from the outer lateral surface 22 of the housing 2 and arranged diametrically opposite each other.

As shown in FIG. 2, a cam follower arrangement 40 is also provided. The cam follower arrangement 40 includes an engine block or cylinder head 42 including a bore 44 and a lubricant gallery 46 in communication with the bore 44. The cam follower arrangement 40 includes the cam follower assembly 1 described above. A camshaft 48 includes a plurality of cams, and at least one of the cams 52 contacts the cam roller 34. The second recessed section 30 is preferably arranged on a side 36 of the pin 24 facing away from the cam 52.

A method of providing lubricant to an annular space 54 defined between a cam roller 34 and a pin 24 in a cam follower assembly 1 is provided. The method includes providing a cam follower assembly 1 including a generally cylindrical housing 2 including an annular groove 4 adapted to be in communication with a lubricant gallery in an engine block or cylinder head. An axial end 10 of the housing 2 includes first and second skirt portions 12, 14 each including an opening 16, 18 defined therethrough. At least one of the first and second skirt portions 12, 14 includes a first recessed section 20 indented from an outer lateral surface 22 of the housing 2 and extending axially between the annular groove 4 and a respective one of the openings 16, 18 of the first and second skirt portions 12, 14. A pin 24 including first and second ends 26, 28 is fixed in the openings 16, 18 of the first and second skirt portions 12, 14. The pin 24 has a second recessed section 30 indented from an outer lateral surface 32 of the pin 24 that extends to at least one of the first or second ends 26, 28 of the pin 24. The second recessed section 30 is in communication with the first recessed section 20. A cam roller 34 is supported on the pin 24. The cam roller 34 can be formed by a bearing outer ring supported by needles or rolling elements on the pin 24, a rolling bearing having an inner ring supported on the pin 24 and an outer ring supported by rolling elements on the inner ring, or possibly by a plain bearing. Hydraulic fluid is supplied to the annular space 54 defined between the cam follower 34 and the pin 24 via the lubricant gallery, the annular groove 4, the first recessed section 20, and the second recessed section 30.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A cam follower assembly comprising:

a cylindrical housing including an annular groove adapted to be in communication with a lubricant gallery in an engine block or cylinder head, an axial end of the housing includes first and second skirt portions each including an opening defined therethrough, and at least one of the first and second skirt portions includes a first recessed section indented from an outer lateral surface of the housing and extending axially with respect to a longitudinal axis of the housing between the annular groove and a respective one of the openings of the first and second skirt portions;

a pin including first and second ends fixed in the openings of the first and second skirt portions, the pin having a second recessed section indented from an outer lateral surface of the pin that extends axially with respect to a longitudinal axis of the pin between the first end of the pin and the second end of the pin, the second recessed section being in communication with the first recessed section; and a cam roller supported on the pin.

2. The cam follower assembly of claim 1, wherein the first and second recessed sections are flats.

3. The cam follower assembly of claim 1, wherein the first and second recessed sections are milled.

4. The cam follower assembly of claim 1, wherein the second recessed section is arranged on a side of the pin facing away from an axial end face of the first and second skirt portions.

5. The cam follower assembly of claim 1, wherein the housing includes two of the first recessed sections, each indented from the outer lateral surface of the housing and arranged diametrically opposite each other.

6. The cam follower assembly of claim 1, wherein the pin is bronze.

7. A cam follower arrangement comprising:

an engine block or cylinder head including a bore and a lubricant gallery in communication with the bore;

a cam follower assembly including:

a cylindrical housing including an annular groove adapted to be in communication with the lubricant gallery in the engine block or cylinder head, an axial end of the housing includes first and second skirt portions each including an opening defined therethrough, and at least one of the first and second skirt portions includes a first recessed section indented from an outer lateral surface of the housing and extending axially with respect to a longitudinal axis of the housing between the annular groove and a respective one of the openings of the first and second skirt portions, a pin including first and second ends fixed in the openings of the first and second skirt portions, the pin having a second recessed section indented from an outer lateral surface of the pin that extends axially with respect to a longitudinal axis of the pin between the first end and the second end of the pin, the second recessed section being in communication with the first recessed section, and a cam roller supported on the pin; and a camshaft including a plurality of cams, and at least one of the cams contacting the cam roller.

8. The cam follower arrangement of claim 7, wherein the second recessed section is arranged on a side of the pin facing away from the cam.

9. A method of lubricating an annular space defined between a cam roller and a pin in a cam follower assembly, the method including:

providing a cam follower assembly including a cylindrical housing including an annular groove adapted to be in communication with the lubricant gallery in the engine block or cylinder head, an axial end of the housing includes first and second skirt portions each including an opening defined therethrough, and at least one of the first and second skirt portions includes a first recessed section indented from an outer lateral surface of the housing and extending axially with respect to a longitudinal axis of the housing between the annular groove and a respective one of the openings of the first and second skirt portions, a pin including first and second ends fixed in the openings of the first and second skirt portions, the pin having a second recessed section indented from an outer lateral surface of the pin that extends axially with respect to a longitudinal axis of the pin between the first end and the second end of the pin, the second recessed section being in communication with the first recessed section, and a cam roller supported on the pin; and supplying hydraulic fluid to the annular space defined between the cam follower and the pin via the lubricant gallery, the annular groove, the first recessed section, and the second recessed section.

* * * * *